US007808454B2

(12) United States Patent
DuHwan et al.

(10) Patent No.: US 7,808,454 B2
(45) Date of Patent: Oct. 5, 2010

(54) DISPLAY DEVICE AND METHOD OF DRIVING THE SAME

(75) Inventors: Oh DuHwan, Chungju-si (KR); Chang JaeWon, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 1023 days.

(21) Appl. No.: 11/289,051

(22) Filed: Nov. 29, 2005

(65) Prior Publication Data

US 2006/0232519 A1 Oct. 19, 2006

(30) Foreign Application Priority Data

Apr. 18, 2005 (KR) ..... 10-2005-0031875

(51) Int. Cl.
*G09G 3/30* (2006.01)

(52) U.S. Cl. ..... 345/76; 315/169.3

(58) Field of Classification Search ..... 345/76–83; 349/73–77, 151; 313/500
See application file for complete search history.

(56) References Cited

U.S. PATENT DOCUMENTS

| | | | | |
|---|---|---|---|---|
| 5,990,629 | A * | 11/1999 | Yamada et al. | 315/169.3 |
| 7,250,931 | B2 * | 7/2007 | Tanada et al. | 345/87 |
| 2003/0034939 | A1 * | 2/2003 | Moon | 345/76 |
| 2004/0041754 | A1 * | 3/2004 | Inukai | 345/76 |
| 2005/0024297 | A1 * | 2/2005 | Shin | 345/76 |
| 2005/0259052 | A1 * | 11/2005 | Shin | 345/77 |
| 2006/0103611 | A1 * | 5/2006 | Choi | 345/82 |

FOREIGN PATENT DOCUMENTS

| | | |
|---|---|---|
| JP | 2001-345176 | 12/2001 |
| JP | 2001-345177 | 12/2001 |
| JP | 2002-032051 | 1/2002 |
| JP | 2003-216106 | 7/2003 |
| JP | 2003-271100 | 9/2003 |
| JP | 2004-145281 | 5/2004 |
| JP | 2004-198493 | 7/2004 |

OTHER PUBLICATIONS

Office Action issued in corresponding Japanese Patent Application No. 2005-377757; issued Jul. 13, 2009.

* cited by examiner

*Primary Examiner*—Alexander Eisen
*Assistant Examiner*—Nelson Lam
(74) *Attorney, Agent, or Firm*—Brinks Hofer Gilson & Lione

(57) ABSTRACT

A display device configured to minimize a layout area of a driver and a method of driving the same is provided. First and second scan drivers are disposed on opposite sides of a display panel. Each of the first and second scan drivers has a plurality of circuit parts corresponding to a plurality of scan lines. A height of the circuit part is equal to a height of subpixels adjacent in a vertical direction. A scan pulse generated from a circuit part of the first scan driver can be supplied to a circuit part of the second scan driver and subpixels disposed on the scan line connected to the circuit part. The circuit part of the second scan driver generates another scan pulse in response to the scan pulse.

10 Claims, 4 Drawing Sheets

DISPLAY DEVICE AND METHOD OF DRIVING THE SAME

This application claims the benefit of the Korean Patent Application No. 31875-2005 filed on Apr. 18, 2005, which is hereby incorporated by reference.

FIELD

The present embodiments relate, generally, to display devices, and more particularly, to a display device configured to minimize a layout area of a driver and a method of driving the same.

BACKGROUND

Cathode ray tubes (CRTs) are typically heavy and bulky. To resolve or obviate these physical disadvantages of the CRTs, flat display devices have been developed. Examples of the flat display devices are a liquid crystal display (LCD), a field emission display (FED), a plasma display panel (PDP), and an electro-luminescence (EL) display device.

The EL display is a self-luminous device that emits light by using a fluorescent material through a recombination of electron and hole. The EL display device falls into two classifications, inorganic and organic, according to corresponding materials and structures. Unlike the LCD, the EL display device does not utilize a separate light source so as to be lightweight and slim. Moreover, the EL display device has a response time comparable to that of the CRT.

FIG. 1 is a sectional view illustrating an organic light-emitting cell of a related art EL display panel.

Referring to FIG. 1, the organic light-emitting cell includes an electron injection layer 4, an electron transport layer 6, an emission layer 8, a hole transport layer 10, and a hole injection layer 12, which are sequentially stacked between a cathode 2 and an anode 14.

When a predetermined voltage V is applied between the anode 14 of a transparent electrode and the cathode 2 of a metal electrode, electrons from the cathode 2 move toward the emission layer 8 through the electron injection layer 4 and the electron transport layer 6. Also, holes from the anode 14 move toward the emission layer 8 through the hole injection layer 12 and the hole transport layer 10. The electrons from the electron transport layer 6 and the holes from the hole transport layer 10 are recombined in the emission layer 8, thereby generating light. Then, the generated light is emitted to the outside through the anode 14 of the transparent electrode and then an image is displayed.

FIG. 2 is a schematic view of a prior art electro-luminescence display device.

Referring to FIG. 2, a related art EL display device includes an EL display panel 16 with subpixels 22, a scan driver 18 for driving scan lines SL1 to SLn, a data driver 20 for driving data lines DL1 to DLm, and a timing controller 28 for controlling the driving timing of the data diver 20 and the scan driver 18. The subpixels 22 are arranged at each pixel region defined by intersections of the scan lines SL1 to SLn and the data lines DL1 to DLm.

One pixel includes R, G and B subpixels 22 arranged in a horizontal direction. Each of the subpixels 22 includes a power supply (VDD) (not shown), an emitting-light cell (OLED) (not shown) connected between the power source (VDD) and a ground source (GND) (not shown), and an emitting-light cell driving circuit (not shown) for driving the emitting-light cell according to a driving signal supplied from the data line DL and the scan line SL.

The timing controller 28 generates a scan control signal for controlling the scan driver 18 and a data control signal for controlling the data driver 20 in response to synchronization signals supplied from an external system (e.g. a graphic card). Also, the timing controller 28 supplies data signal from the external system to the dada driver 20.

The scan driver 18 generates a scan pulse (SP) in response to the scan control signal outputted from the timing controller 28, and transfers the scan pulse (SP) to the scan lines SL1 to SLn, thereby driving the scan lines SL1 to SLn in sequence.

The data driver 20 supplies a current signal to data lines DL1 to DLm according to the data control signal outputted from the timing controller 28. The current signal has a current level or pulse width responsive to the data signal at each horizontal period (1H). As such, the data driver 20 has DLm number of output channels, which are matched one-to-one with the data lines DL1 to DLm.

The EL display device supplies each of the subpixels 22 with the current signal having a current level or pulse width proportional to input data. Then, each of the subpixels 22 emits light in proportion to an amount of current supplied from each of the data lines DL.

In the described EL display device, the scan driver 18 is disposed in one side of the EL display panel 16 in a vertical direction and is integrated into the panel 16.

Referring to FIG. 2, in the described EL display panel 16 in which R, G and B subpixels 22 are arranged in this order in a horizontal direction, the scan driver 18 includes n number of circuit parts 19 each corresponding to a height A of each of the subpixels 22. Each of the circuit parts 19 has a predetermined width B. That is, the number of the circuit terminals 19 corresponds to that of the scan lines SL1 to SLn arranged in the EL display panel 16. As such, each circuit part 19 has a layout area given by multiplying the height A of each subpixel 22 by the width B of each circuit part 19.

The circuit parts 19 provide a turn-on voltage to a plurality of subpixels 22 connected to the scan lines SL1 to SLn.

The scan driver 18 of the related art EL display device needs a layout area corresponding to "height A of each subpixel×width B of each circuit terminal×number (n) of the scan lines".

When the scan driver 18 is disposed in only one side of the panel 16, the layout area as wide as the scan driver 18 is disposed in only one side of the EL display panel 16. Therefore, the display panel 16 is not placed in the middle of the EL display device. Moreover, an entire size of the EL display device increases as the layout area of the scan driver 18 increases.

SUMMARY

The present invention is defined by the appended claims. This description summarizes some aspects of the present embodiments and should not be used to limit the claims.

A display device and a method of driving the same are provided that substantially obviate one or more problems due to limitations and disadvantages of the related art.

A display device having a more compact panel achieved by dispersing drivers to opposite sides of a panel is provided to thereby minimize a layout area of a driver, and a method of driving the same.

A display device is provided that includes a display panel having an R, G and B subpixels arranged in intersections between a plurality of data lines and a plurality of scan lines. A scan driver drives the scan lines. A data driver drives the data lines. The scan driver includes first and second scan drivers disposed on opposite sides of the display panel, thereby minimizing a layout area of the scan driver.

In another feature, a method of driving a display device is provided. The display device includes a display panel having R, G and B subpixels formed in intersections between a plurality of data lines and a plurality of scan lines. First and second scan drivers are disposed on opposite sides of the scan lines to drive the scan lines; and a data driver for driving the data lines. In the disclosed method, a first scan signal is supplied from the first scan driver to a first scan line. Subpixels disposed on the first scan line are selected in response to the first scan signal, and the first scan signal is supplied to the second scan driver. A predetermined image is displayed on the selected subpixels according to a data signal supplied from the data driver. A second scan signal is supplied in response to a second scan signal from the second scan driver to a second scan line.

It is to be understood that both the foregoing general description and the following detailed description of the present embodiments are exemplary and explanatory and are intended to provide further explanation of the invention as claimed.

BRIEF DESCRIPTION OF THE DRAWINGS

The accompanying drawings, which are included to provide a further understanding of the present embodiments and are incorporated in and constitute a part of this application, illustrate the present embodiment(s) and together with the description serve to explain the present embodiment(s). In the drawings.

DETAILED DESCRIPTION

Reference will now be made in detail to the preferred embodiments, examples of which are illustrated in the accompanying drawings. Wherever possible, the same reference numbers will be used throughout the drawings to refer to the same or like parts.

Figure 3:
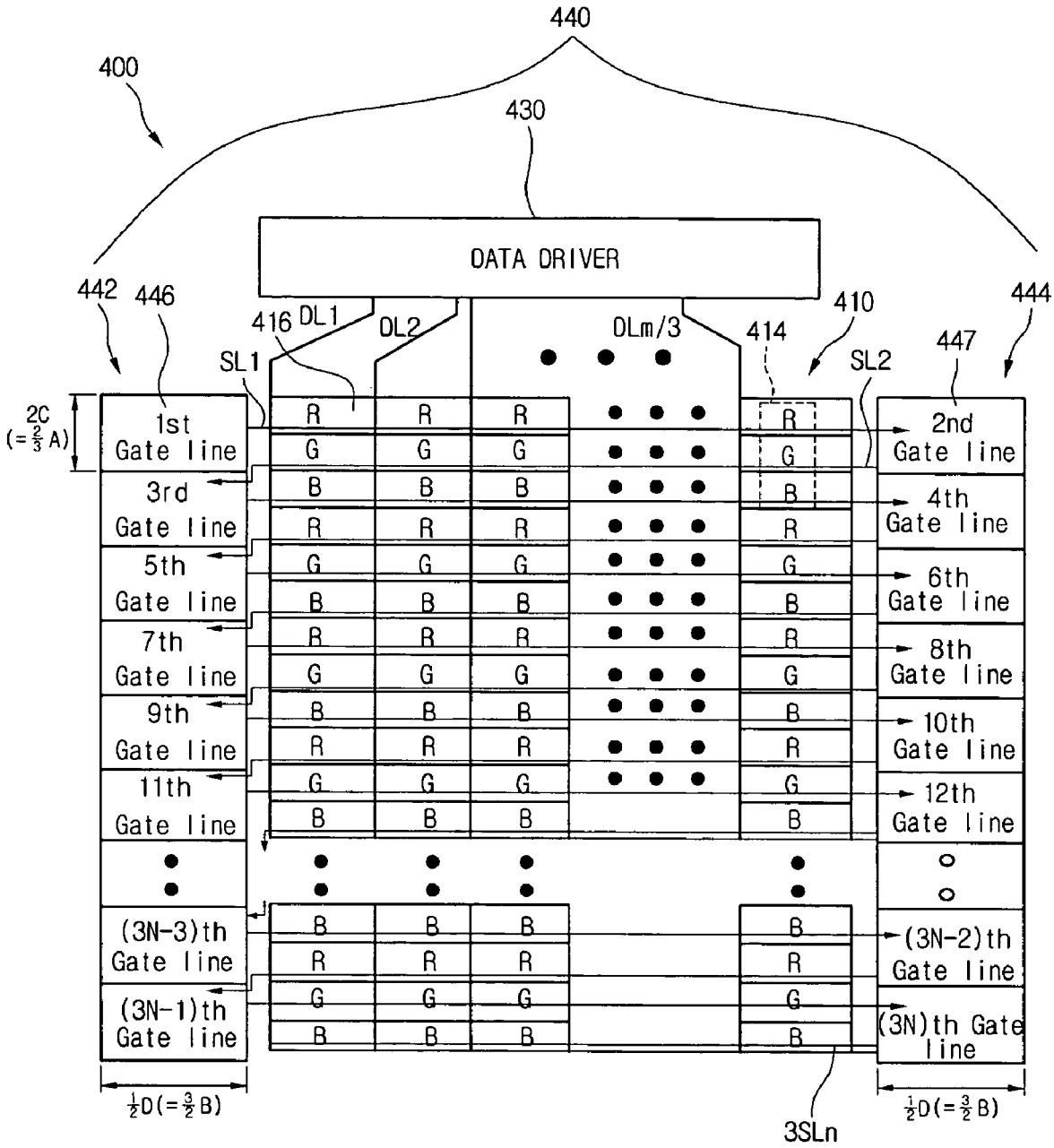
FIG. 3 is a schematic view of one embodiment of an EL display device.

FIG. 3 is a schematic view of an embodiment of an EL display device.

Referring to FIG. 3, the EL display device 400 includes an EL display panel 410, a scan driver 440 for driving scan lines SL1 to 3SLn, a data driver 430 for driving data lines DL1 to DLm/3, and a timing controller (not shown) for controlling the driving timing of the data driver 430 and the scan driver 440. The EL display panel 410 includes subpixels 416 arranged in pixel regions defined by intersections of scan lines SL1 to 3SLn and data lines DL1 to DLm/3.

One pixel 414 includes R, G and B subpixels 416 arranged in a vertical stripe form. Moreover, a pair of scan drivers 440 is disposed on opposite sides of the EL display panel 410 so as to minimize a layout area of the scan driver 440.

While the related art pixel includes R, G and B subpixels 22 arranged in a horizontal direction, the pixel 414 of the vertical stripe form of the present invention includes R, G and B subpixels 416 arranged in a vertical direction.

According to the related art, three data lines and one scan line are used to drive one pixel. However, according to the present embodiments, one data line and three scan lines are used to drive one pixel 414 of in the vertical stripe form.

According to the related art, because the R, G and B subpixels 22 are arranged in a horizontal direction, three data lines extended from an upper portion of the panel are used. Also, one scan line is extended from a side of the panel 16 to pass through the R, G and B subpixels 22 arranged in a horizontal direction and drive them. On the contrary, according to the present embodiments, because the R, G and B subpixels 416 are arranged in a vertical direction, three of the scan lines SL1 to 3SLn extended from a side of the panel 410 are used. Also, one of the data lines SL1 to 3SLn extended from an upper portion of the panel 410 passes through the R, G and B subpixels 416 arranged in a vertical direction and drives them.

Accordingly, in the EL display panel 410 with the pixel 414 of the vertical stripe form, the number of pins for output channels can be reduced by a third (⅓) as compared to the related art data driver 20.

Figure 1:
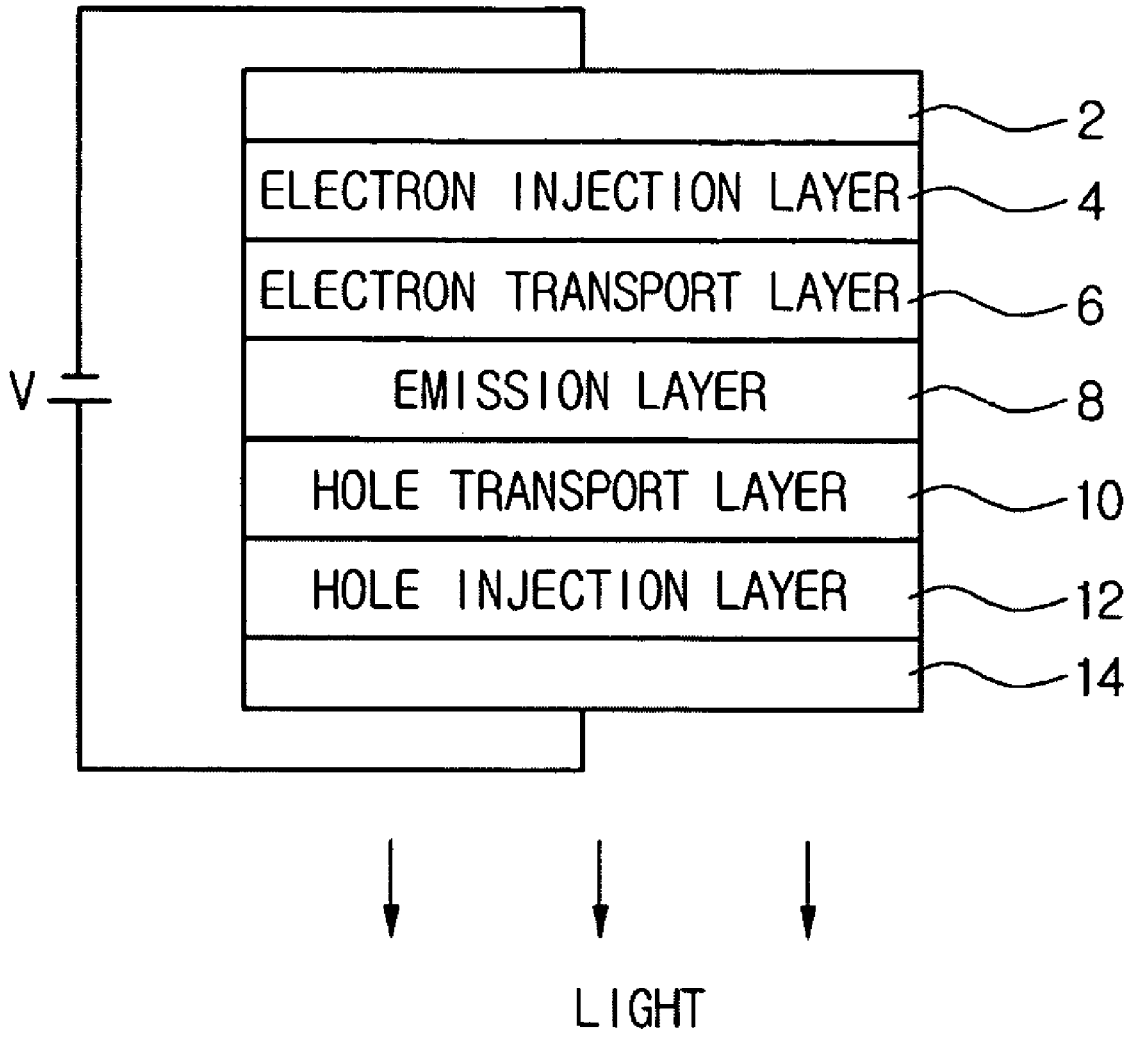
Fig. 1 (Related Art)
FIG. 1 is a sectional view illustrating an organic light-emitting cell of a related art EL display panel.
Figure 2:
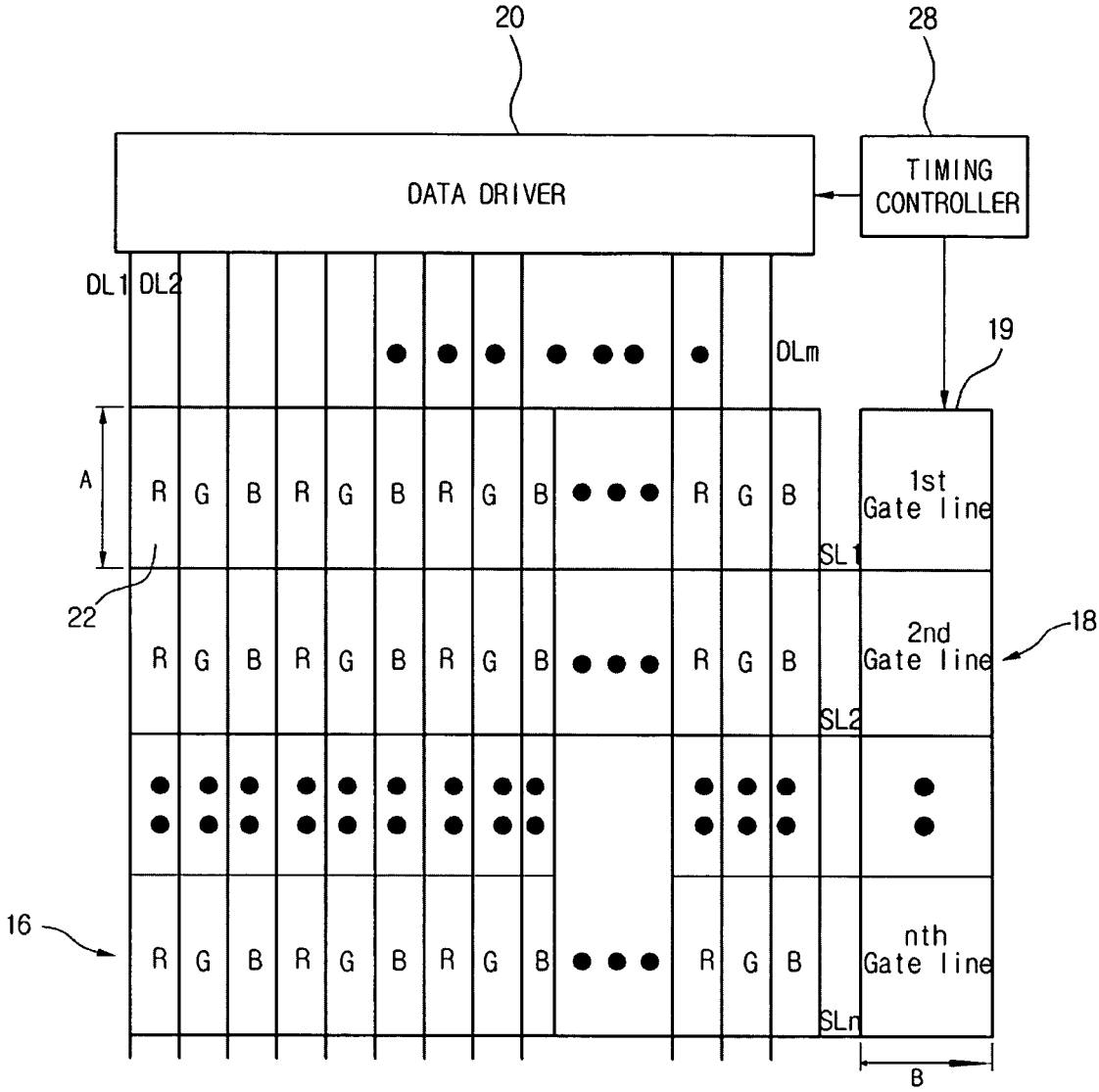
Fig.2 (Related Art)
FIG. 2 is a schematic view illustrating a related art EL display device.

However, when one scan driver is provided in only one side of the display panel 410 where the pixels 414 are arranged in the vertical stripe form, the scan driver has n number of circuit parts corresponding to the height of the subpixels C, and each of the circuit parts has a predetermined width D. Therefore, one scan driver requires a layout area corresponding to "the height C of each subpixel×the predetermined width D×the number (n) of the scan lines". The circuit parts provide a turn-on voltage to a plurality of subpixels connected to the scan lines extended one by one. Since the height C of the subpixel is about ⅓ of the height A of the related art subpixel 22 shown in FIG. 2, the height of the circuit part of the scan driver is reduced by a third (⅓) as compared with the related art circuit part. However, the width D of the circuit part is three times wider than the width B of the related art circuit part shown in FIG. 2. That is, even when the EL display device 400 where the subpixels are arranged in the vertical stripe form, if only one scan driver is placed on one side of the display panel, the layout area as wide as the scan driver is needed. Therefore, compared with the related art EL display device of FIG. 2, the layout area in a horizontal direction is increased.

According to the present embodiment, the scan driver 440 includes a first scan driver 442 and a second scan driver 444 located on opposite sides of the EL display panel 410, rather that on one side thereof. A height of each of the circuit parts 446 and 447 for the first and second scan drivers 442 and 444 is two times higher than the height C of the subpixel 416 of the vertical stripe form. That is, the height of the circuit part is equal to "2C" corresponding to the height of two subpixels 416 adjacent in a vertical direction. Also, the width of the circuit part is reduced by ½ times the width D of the circuit part having one scan driver. Consequently, the layout area of the scan driver 440 can be minimized.

According to the present embodiment, a potential problem that the panel size increases due to the horizontal expansion of the layout area of the scan driver 440 may be mitigated. Therefore, the panel 410 can be substantially more compact than the EL display device 400 using the subpixels 416 arranged in a vertical stripe form.

The scan driver 440 includes the first scan driver 442 and the second scan driver 444 arranged on left and right of the active area with the EL display panel 410.

Referring to FIG. 3, the first scan driver 442 includes odd circuit parts 446 and the second scan driver 444 includes even circuit parts 447. The present embodiments may, however, be in many different forms and should not be construed as limiting.

The first and second scan drivers 442 and 444 include circuit parts 446 and 447, respectively. The layout of the circuit parts 446 and 447 has a height 2C of two subpixels 416 in a vertical direction. In response to output signals of the first scan driver 442, thin film transistors of the subpixels 416 connected to the odd scan lines are turned on/off. The output signals of the first scan driver 442 are used as input signals of the second scan driver 444.

Similarly, in response to output signals of the second scan driver 444, thin film transistors of the subpixels 416 connected to the even scan lines are turned on/off. The outputs of the second scan driver 444 are used as input signals of the first scan driver 442.

Figure 4:
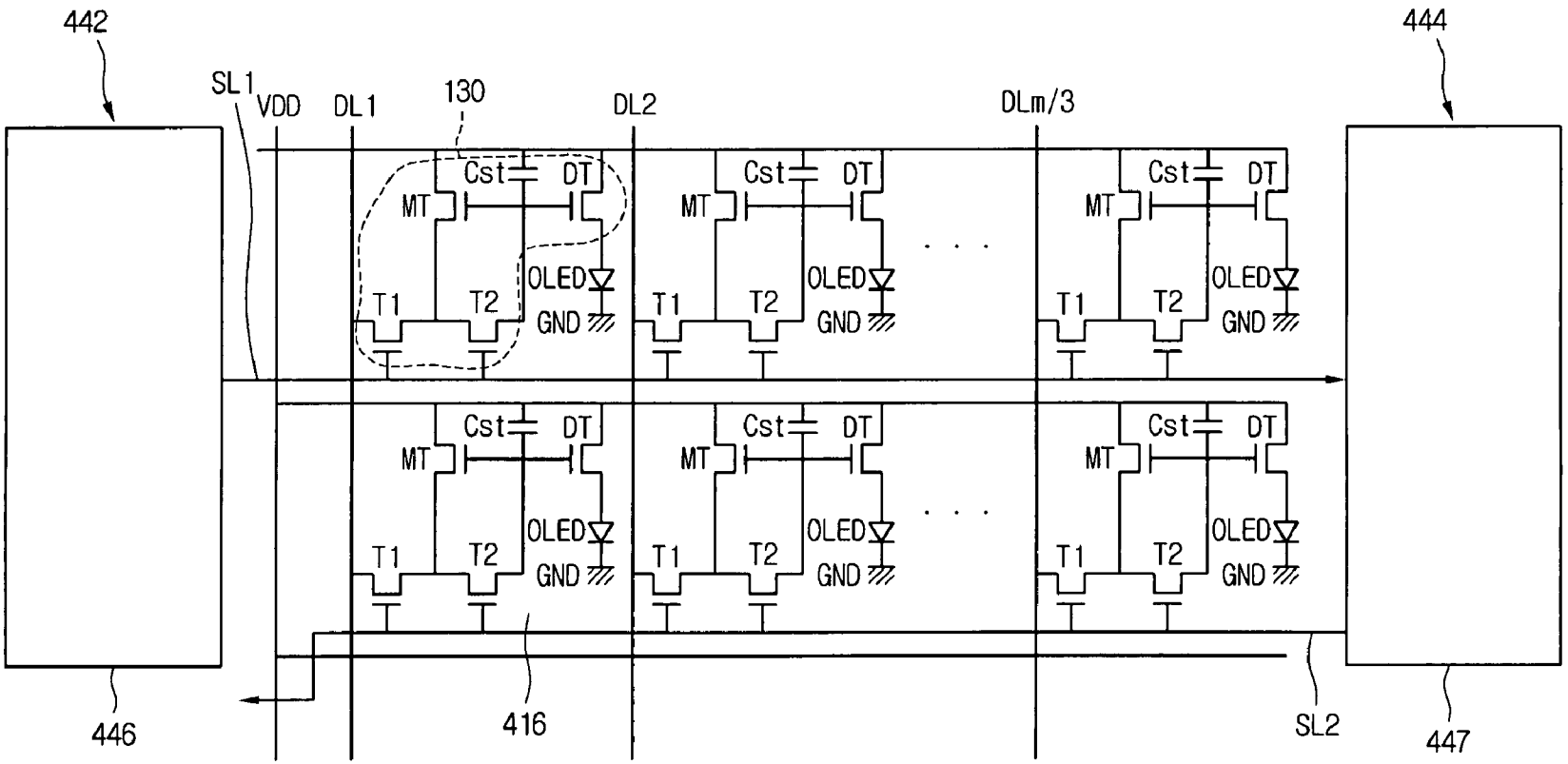
FIG. 4 is a circuit diagram of the EL display device illustrated in FIG. 3.

FIG. 4 is a circuit diagram illustrating subpixels between the circuit parts of the first and second scan drivers 442, and 444 in the EL display device 400 of FIG. 3.

Referring to FIGS. 3 and 4, the EL display device 400 is provided in a vertical stripe form. That is, one pixel 414 includes R, G and B subpixels 416 arranged in a vertical direction. In order to minimize a layout area of the scan driver 440, a pair of scan drivers 440 is disposed on opposite sides of the EL display panel 410. The scan driver 440 includes the first and second scan drivers 442 and 444. A height of each of the circuit parts for the first and second scan drivers 442 and 444 is two times higher than the height C of the subpixel 416 of the vertical stripe form. That is, the height of the circuit part is equal to "2C" corresponding to the height of two subpixels 416 adjacent in a vertical direction. Also, the width of the circuit part is reduced by ½ times the width D of the circuit part in each of the scan drivers 442 and 444. Consequently, the layout area of the scan driver 440 can be minimized.

The first and second scan drivers 442 and 444 are arranged on left and right of the active area with the EL display panel 410. The first scan driver 442 includes the odd circuit parts 446 and the second scan driver 444 includes the even circuit parts 447, and vice versa.

The first and second scan drivers 442 and 444 include circuit parts 446 and 447, respectively. The layout of the circuit parts 446 and 447 has a height 2C of two subpixels 416 in a vertical direction. In response to output signals of the first scan driver 442, thin film transistors of the subpixels 416 connected to the odd scan lines are turned on/off. The output signals of the first scan driver 442 are used as input signals of the second scan driver 444. Similarly, in response to output signals of the second scan driver 444, thin film transistors of the subpixels 416 connected to the even scan lines are turned on/off. The outputs of the second scan driver 444 are used as input signals of the first scan driver 442.

As described above, the pixel 414 is provided in a vertical stripe form. Moreover, the R, G and B subpixels 416 for one pixel 414 of the vertical stripe form are arranged not in a horizontal direction but in a vertical direction.

Referring to FIG. 4, the pixel 414 of the vertical stripe form includes subpixels 416. Each of the subpixels 416 includes a light-emitting cell OLED connected between a power supply voltage VDD and a ground voltage GND, and a driving circuit 130 for driving the light-emitting cell OLED in response to a driving signal supplied from the data line DL and the scan line SL.

A driving circuit 130 includes a drive TFT DT, a first switching TFT T1, a second switching TFT T2, a conversion TFT MT, and a storage capacitor Cst. The drive TFT DT is connected between the power supply voltage VDD and the light-emitting cell OLED. The first switching TFT T1 is connected to the scan line SL and the data line DL. The second switching TFT T2 is connected to the first switching TFT T1 and the drive TFT DT. The conversion TFT MT is connected between a common node of the first and second switching TFTs T1 and T2 and the power supply voltage VDD. The conversion TFT MT forms a current mirror together with the drive TFT TD and converts a current into a voltage. The storage capacitor Cst is connected between the power supply voltage VDD and gates of the drive TFT DT and the conversion TFT MT.

The drive TFT DT has the gate connected to the gate of the conversion TFT MT, a source connected to the power supply voltage VDD, and the drain connected to the light-emitting cell. The conversion TFT MT has a source connected to the power supply voltage VDD, the drain commonly connected to the drain terminal of the first switching TFT T1 and the source of the second switching TFT T2. The first switching TFT T1 has a source connected to the data line DL, and the drain connected to the source of the second switching TFT T2. The second switching TFT T2 has the drain connected to the gates of the drive TFT DT and the convert TFT MT and the storage capacitor Cst. The gates of the first switching TFT T1 and the second switching TFT T2 are commonly connected to the scan line.

Assuming that the conversion TFT MT and the drive TFT DT may have the same characteristics because they are placed closely to form the current mirror, if the conversion TFT MT and the drive TFT DT are formed with same size, then an amount of a current flowing through the conversion MT may be equal to that flowing through the drive TFT DT.

With this arrangement, the EL display device 400 may supply the subpixels 416 with a current signal having a current level or pulse width proportional to the input data. The subpixels 416 may emit light in proportion to an amount of the current supplied from the data line DL.

An operation of the EL display device 400 will now be described.

A first scan pulse is generated from the first circuit part of the first scan driver 442 and is supplied to a first scan line SL1. The subpixels 416 on the first scan line SL1 are selected in response to the first scan pulse supplied from the first scan line SL1.

A first data signal from the data driver 430 is supplied to the data lines DL1 to DLm/3 connected to the selected subpixels 416. The first data signal supplied to the data lines DL1 to DLm/3 is transferred to the selected subpixels 416 and then a predetermined image is displayed.

Meanwhile, the first scan pulse is inputted to the first circuit part of a second scan driver 444. The first scan driver 442 is connected to the second scan driver 444 through the scan lines SL1 to 3SLn. That is, the first circuit part of the first scan driver 442 is connected to the first circuit part of the second scan driver 444 through the first scan line SL1. The first circuit part of the second scan driver 444 is connected to the second circuit part of the first scan driver 442 through the second scan line SL2. The second circuit part of the first scan driver 442 is connected to the second circuit part of the second scan driver 444 through the third scan line SL3. With this arrangement, the first scan driver 442 can be connected to the second scan driver 442 through the remaining scan lines.

As such, the first circuit part of the second scan driver 444 is driven in response to the first scan pulse. That is, the first circuit part of the second scan driver 444 generates a second scan pulse in response to the first scan pulse, and then supplies it to the second scan line SL2. Subpixels 416 on the second scan line SL2 are selected in response to the second scan pulse supplied to the second scan line SL2.

The second dada signal from the data driver 430 is supplied to the data lines DL1 to DLm/3 connected to the selected subpixels 416. The second data signal from the dada lines DL1 to DLm/3 is supplied to the selected subpixels 416. Through these processes, a predetermined image is displayed.

As such, all subpixels 416 of the EL display panel 410 can be displayed in frame unit.

According to the present embodiment, a pair of scan drivers 442, 444 is provided on either side of the display panel 410 where pixels 414 are provided in a vertical stripe form, and thus the layout area of the scan driver 440 can be minimized. Consequently, the panel can be fabricated more compactly.

In addition, by providing the scan drivers 442 and 444 on opposite sides of the display panel 410, the display panel 410 can be placed in the middle of the EL display device 400 with minimal layout loss.

It will be apparent to those skilled in the art that various modifications and variations can be made in the present embodiments. Thus, it is intended that the present embodiments cover the modifications and variations of this invention provided they come within the scope of the appended claims and their equivalents.

What is claimed is:

1. A display device comprising:

a display panel having a plurality of pixels, each of the plurality of pixels having R, G and B subpixels arranged in intersections between a plurality of data lines and a plurality of scan lines, a plurality of thin film transistors formed in the intersections, the R, G and B subpixels being arranged in a vertical direction;

first and second scan drivers disposed on opposite sides of the display panel to drive the plurality of scan lines; and a data driver that drives the plurality of data lines, wherein the first scan driver includes a plurality of circuit parts and the second scan driver includes a plurality of circuit parts, and wherein each circuit part of the first scan driver is connected to each circuit part of the second scan driver through each scan line, wherein the plurality of thin film transistors include a respective first thin film transistor of the subpixels connected to an odd scan line of scan line and a respective second thin film transistor of the subpixels connected to an even scan line of scan lines, wherein the first thin film transistor is turned on/off in response to output signals of the first scan driver and the second thin film transistor is turned on/off in response to output signals of the second scan driver, wherein a height of each circuit part is equal to that of two subpixels adjacent in the vertical direction.

2. The display device according to claim 1, wherein each of the plurality of pixels included in the display panel has a vertical stripe form.

3. The display device according to claim 1, wherein the plurality of circuit parts of the first scan driver generate a scan signal to be supplied to scan lines.

4. The display device according to claim 1, wherein the plurality of circuit parts of the second scan driver generates a scan signal to be supplied to scan lines.

5. The display device according to claim 1, wherein a scan signal from one of the circuit parts of the first scan driver is supplied to the subpixels disposed on a corresponding scan line and one of the circuit parts of the second scan driver.

6. The display device according to claim 5, wherein the one of the circuit parts of the second scan driver generates another scan signal in response to the scan signal from the one of the circuit parts of the first scan driver.

7. The display device according to claim 1, wherein a scan signal from one of the circuit parts of the second scan driver is supplied to the subpixels displayed on a corresponding scan line and one of the circuit parts of the first scan driver.

8. The display device according to claim 7, wherein the one of the circuit parts of the first scan driver generates another scan signal in response to the scan signal from the one of the circuit parts of the second scan driver.

9. The display device according to claim 1, wherein the adjacent subpixels have two subpixels.

10. A method of driving a display device, the display device including: a display panel having R, G and B subpixels formed in intersections between a plurality of data lines and a plurality of scan lines, a plurality of thin film transistors formed in the intersections; first and second scan drivers disposed on opposite sides of the display panel to drive the scan lines; and a data driver for driving the data lines, wherein the first scan driver includes a plurality of circuit parts and the first scan driver includes a plurality of circuit parts, and wherein each first circuit part is connected to each second part through each scan line, the method comprising:

a) supplying a first scan signal from a first circuit part of the first scan driver to a first scan line;

b) selecting subpixels disposed on the first scan line in response to the first scan signal, and supplying the first scan signal to a first circuit part of the second scan driver;

c) displaying a predetermined image on the selected subpixels according to a data signal supplied from the data driver;

d) generating a second scan signal in response to the first scan signal from the first circuit part of the first scan driver by the first circuit part of the second scan driver;

e) supplying the second scan signal to a second scan line; and f) repeating the steps b) to e), wherein the R, G and B subpixels being arranged in a vertical direction, wherein the plurality of thin film transistors include a respective first thin film transistor of the subpixels connected to an odd scan line of scan line and a respective second thin film transistor of the subpixels connected to a even scan line of scan lines, wherein the first thin film transistor is turned on/off in response to output signals of the first scan driver and the second thin film transistor is turned on/off in response to output signals of the second scan driver, wherein a height of each circuit part is equal to that of two subpixels adjacent in the vertical direction.

* * * * *